United States Patent [19]

Mammino et al.

[11] 3,937,665

[45] Feb. 10, 1976

[54] PHOTORECEPTOR SOLVENT CLEANER

[75] Inventors: Joseph Mammino, Penfield; Franklin Jossel, Rochester, both of N.Y.

[73] Assignee: Xerox Corporation, Stamford, Conn.

[22] Filed: Feb. 27, 1975

[21] Appl. No.: 553,783

[52] U.S. Cl. ..... 252/162; 134/40; 252/171

[51] Int. Cl.[2] ..... C11D 7/50

[58] Field of Search ..... 252/162, 163, 170, 171; 134/40, 22

[56] References Cited

UNITED STATES PATENTS

| | | | |
|---|---|---|---|
| 2,032,174 | 2/1936 | Johnson | 252/162 UX |
| 2,509,197 | 5/1950 | Borus et al. | 252/162 UX |
| 3,535,160 | 10/1970 | Arger | 134/22 |
| 3,702,303 | 11/1972 | Clemens | 252/163 |
| 3,773,676 | 11/1973 | Boyles | 252/171 |

*Primary Examiner*—William E. Schulz

*Attorney, Agent, or Firm*—J. J. Ralabate; D. C. Kolasch; A. W. Karambelas

[57] ABSTRACT

A photoreceptor cleaning composition is provided which includes a solvent blend that is capable of dissolving toner polymers and paper tars. This composition cleans effectively and efficiently without damage to the photoreceptor and without leaving residue. This solvent employs a blend of halogenated hydrocarbons having specific physical and chemical properties. These compositions are superior to known cleaners by virtue of their minimizing potential for fire explosion and hazard resulting from toxicity and volatility.

5 Claims, No Drawings

PHOTORECEPTOR SOLVENT CLEANER

BACKGROUND OF THE INVENTION

This invention relates to cleaning compositions and more particularly to the cleaning of photoconductive insulating surfaces. More specifically this invention relates to the cleaning of reusable electrophotographic plate belts or drums conventionally employed in the electrophotographic imaging process.

In an electrophotographic imaging process for example, more specifically disclosed in Carlson, U.S. Pat. No. 2,297,691 an electrophotographic plate comprising a photoconductive insulating material on a conductive backing is uniformly charged over its surface and then exposed selectively to produce a latent electrostatic image. Thereafter a latent electrostatic image is developed employing an electroscopic marking powder known in the art as toner normally employed in connection with a carrier to form a visible reproduction of the original employed. This development of the latent electrostatic image generally employs an electrostatically attractable material which is normally a thermoplastic resin in the form of finely divided particles usually in the range of from 3 to 20 microns. The toner is applied by bringing the photoconductive surface bearing the latent electrostatic image into contact with the powder, the charged areas normally retaining the toner particles. The developed image may then be transferred to a suitable support material such as paper and then fixed if desired by heating and/or application of a solvent or the like. In the transfer steps substantially all of the resin material or toner adheres to support material to form the image thereon, but usually a very small percentage of the resin material or toner remains on the electrophotographic surface.

These trace amounts of resin material or toner remaining on the electrophotographic surface are found to affect future operating steps of the process, and if left to remain thereon, will provide an undesirable cumulative effect. Additional residual toner particles adhere more readily to the surface in both image and non-image areas and consequently image deterioration results. It is found that in automatic imaging machines employing rotary drums, continuous cleaning of such residual toner particles is effected with a rotating brush in peripheral contact with the surface of the electrophotographic surface which removes any residual resin material or toner adhering thereon. This brush in turn is cleaned by the use of a flicking bar in combination with a vacuum system whereby residual resin material or toner removed from the brush by the flicking bar is entrained in air and then subsequently separated from the air by a suitable filter.

Washing techniques have been employed to remove loosely held toner residue employing non-solvent liquids such as water, alcohols and mixtures thereof. However, residue toner which is firmly held by any means e.g., chemical or nonchemical, is not effectively removed with these wash techniques. In addition since these wash substances contain alcohol they are flammable. Liquids which are considered flammable are those which exhibit flash point at or above 140°F are described in Fundamentals of Industrial Hygiene published by National Safety Council, 1971.

This continuous cleaning of the photoconductive insulating surface or other methods that may be employed in the art are not effective to completely remove the toner material from the photoconductive insulating surface and, therefore, repeated use of the photoconductive insulating surfaces causes a thin film of the toner material to be formed thereon which adversely affects the reproduction process. In addition, the thin film of toner material is removed from the photoconductive insulating surface of commercial machines by effecting periodic cleaning with a solvent which is generally flammable. Numerous attempts have been made to develop a non-flammable cleaner for removing residual toner film from the photoconductive insulating surface but such attempts have generally been unsuccessful since they themselves have resulted in additional problems such as cleaner staining or spotting of the photosensitive insulating layer, desensitizing the layer, crystallizing the layer, or otherwise interfering with the functional properties of the photoconductive layer.

In U.S. Pat. No. 3,702,303 a composition for cleaning photoconductive insulating surfaces comprising an aqueousorganic liquid emulsion in a surfactant is disclosed. The composition recited may include an abrasive and a suspending agent and preferably includes a non-flammable organic liquid such as, for example, tetrachlorethylene which is emulsified in the water in an amount to control the volatility thereof and thereby provide a composition which evaporates from the surface to be cleaned at a rate that permits effective cleaning without producing solvent films or stains. However, the emulsifiers employed leave residues which are not desirable in some applications.

Modern photoconductive members in some cases employ distinct alloy layers which vary in thickness and all of which are extremely thin, i.e., below 60 microns in thickness, and preferably are below 10 microns. It is readily found that any abrasion of the top layers or layer of these photoreceptors leads to an immediate and dramatic loss of panchromaticity and hence the photoreceptor is no longer suitable for use in a color imaging process. For example, the abrasion is normally experienced during the course of cleaning the photoreceptor surface of condensed toner polymer residue and paper tars as above explained. Normally this is caused by the presence of cleaning aids which are non-solvents for the polymer and paper tars and reliance on some pumicing action for cleaning. In addition to high flammability, and the problems associated when employing compounds containing pumice, toxicity is also a very real factor in the environment in which these compositions are employed.

There is, therefore, a demonstrated need to provide improved cleaning compositions for photoreceptor surfaces.

It is, therefore, an object of this invention to provide a cleaning composition for photoreceptor surfaces devoid of the above noted deficiencies.

A further object of this invention is to provide a non-flammable cleaning composition for cleaning photoreceptor insulating surfaces.

Another object of this invention is to provide a non-abrasive cleaning composition suitable for cleaning photoreceptor surfaces in automatic electrophotographic imaging machines.

Yet another object of this invention is to provide cleaning compositions which may have low toxicity so as to provide a safe environment for use.

Yet another object of this invention is to provide a non-explosive cleaning composition for photoreceptor surfaces.

Yet again another object of this invention is to provide a novel cleaning composition which will not alter or effect the photoconductive properties of conventionally employed photoreceptors.

These and other objects of the instant invention are accomplished generally speaking by providing a photoreceptor cleaning composition comprising a solvent blend which dissolves toner polymers and paper tars without damage to the photoreceptor and without leaving residues. The solvent is a blend of halogenated hydrocarbons which exhibits no flash point, TAG Open Cup, ASTM Method D-1310 and a petroleum hydrocarbon having a closed cup flash point of over about 135°F. When these compositions are employed as described, the potential for fire and explosion is minimized and hazards resulting from toxicity and volatility are likewise minimized.

The halogenated hydrocarbon employed is designated as Chlorothene NU, which chemically is 1,1,1 trichloroethane. Extensive toxicological studies on laboratory animals and human subjects show that this material does not present any serious or unusual health hazard. Occasional contacts with the skin of short duration are not likely to cause adverse effects. No serious injury results to the eyes upon contact, however, appreciable discomfort may be experienced. The swallowing of Chlorothene NU presents no problem in ordinary industrial handling. Supportive documentation for those claimed properties may be found in *Fundamentals of Industrial Hygiene*, published by National Safety Council, 1971.

The petroleum distillate employed is designated as a depolarized (deodorized) APCO 140, a water-white petroleum solvent prepared from crude oil by straight run overhead distillation which is then specially treated for deodorization under depolarization process U.S. Pat. No. 2,553,624. The depolarization process removes impurities present and results in improvement in color lowering sulphur content and a reduction in odor intensity. This material is found to have the following specifications:

| | Min. | Max. |
|---|---|---|
| I.B.P. | 358°F | 368°F |
| 5% | 361 | 371 |
| 10% | 362 | 372 |
| 50% | 368 | 378 |
| 90% | 377 | 387 |
| 95% | 382 | 392 |
| 97% | 399 | 409 |
| Recovery | | 98% |
| Color | | Water-White |
| Doctor Test | | Negative |
| Corrosion — 3 hours at 212°F | | OK |

in addition to others. Although the flammability of this petroleum distillate is somewhat less hazardous than kerosene, its combination with the halogenated hydrocarbon results in a non-flammable composition. In addition, the combination of this material with the halogenated hydrocarbon material recited above results in a composition which is not detrimental to the eyes, and skin and is substantially non-toxic when employed in ordinary use.

It is found that this composition when employed as a cleaning solution for an electrophotographic photoreceptor does not abrade the photoreceptor or in any way eliminate or curtail panchromaticity. This composition is found to act through a true solvency effect. It is found to be very effective in removing traces of paper tars and residual toner on the photoreceptor surface and is able to restore the photoreceptor to a clean operational condition.

The halogenated hydrocarbon and petroleum may be employed in any suitable ratio. Generally a ratio of from about 99:1 halogenated hydrocarbon to petroleum distillate to 50:50 is generally employed. Optimum results are obtained when a 93:7 halogenated hydrocarbon to petroleum distillate ratio is employed.

The above composition is applied to saturation on a fist sized wad of cleaning absorbent. The photoreceptor is contacted on its surface with the solvent soaked cleaning absorbent while it is slowly rotated. Negligible pressure is applied to the photoreceptor surface. This application is made as uniformly as possible as the photoreceptor surface is revolved until the photoreceptor surface is cleaned which may require several passes of the absorbent material. The photoreceptor surface is then allowed to dry and then it is returned to its operational mode. Before use, the photoreceptor surface is normally dried with a dry clean absorbent material. When dry, the photoreceptor is remounted in the cavity in its operational mode and 10 to 20 full color copies for example are produced to assure that densities are returned to normal and that the image area of the photoreceptor has not in any way been damaged.

It is not necessary to employ coloring, and perfuming to the cleaning composition of the instant invention. In addition to not altering or affecting the physical surface area of the photoreceptor surface, sensimetric data before and after cleaning with the cleaning solution of the instant invention indicate that the photoreceptor shows no effect whatsoever by reason of its application other than cleaning the surface.

To further define the specifics of the present invention, the following examples are intended to illustrate and not limit the particulars of the present system. Parts and percentages are by weight unless otherwise indicated.

EXAMPLE I

About 90 parts by volume of Chlorothene NU 1,1,1 trichloroethane is mixed with 10 parts by volume of APCO-140 a petroleum distillate the properties of which have heretofore been defined having a petroleum hydrocarbon fraction with a distillation range of from 358°F to 409°F to provide the cleaning solution. A photoreceptor extension shaft is installed in Xerox 6500 copier a conventional color automatic imaging machine and the photoreceptor is pulled out of the cavity onto the shaft. A fist size wad of cleaning absorbent is saturated with the cleaning solvent. The photoreceptor is then spun on the extension shaft at about 2 to 3 revolutions per second while the solvent soaked cleaning absorbent material is applied to the surface of the photoreceptor near the outboard end. Absolute minimum pressure is applied to clean the photoreceptor. The saturated pad is slowly moved inboard and outboard across the surface of the photoreceptor while the photoreceptor is continuously spun until the photoreceptor is observably determined to be cleaned. This normally requires several passes. The photoreceptor is then dried before returning to the cavity with a dry cleaning absorbent. The dried photoreceptor is then remounted in the cavity and 10 to 20 full color copies are run to assure that the densities have returned to normal, and that the image of the photoreceptor has not been damaged. The clean photoreceptor is found to produce copies of high contrast and quality when re-employed in the automatic color imaging apparatus. When sensimetric data are run before and after on this photoreceptor cleaning drum no effect is shown from application of this cleaning solution.

EXAMPLE II

The procedure as outlined in Example I is again performed with the exception that a 50:50 Chlorothene NU to APCO-140 solution is employed. Although the photoreceptor thoroughly and efficiently is cleaned, it is found that the operation is not as expeditiously performed as in Example I.

EXAMPLE III

The procedure as outlined in Example I is again performed with the exception that a 93:7 ratio of Chlorothene NU to APCO-140 is employed. It is found that less cleaning time is required than both Examples I and II and otherwise similar results are obtained.

What is claimed is:

1. A method of cleaning photoreceptor surfaces comprising providing a filmed photoreceptor surface, applying a photoreceptor cleaning solution which comprises a solvent blend capable of dissolving toner polymers and paper tars, said blend comprising a halogenated hydrocarbon exhibiting no flash point, as determined by TAG Open Cup, ASTM Method D-1310 and a petroleum hydrocarbon having a closed cup flash point of over about 135°F.

2. The process as defined in claim 1 wherein said halogenated hydrocarbon comprises 1,1,1 trichloroethane.

3. The process as defined in claim 1 wherein said petroleum hydrocarbon is water-white petroleum solvent prepared from crude oil by straight run overhead distillation, said solvent having been treated for deodorization by a depolarization process.

4. The process as defined in claim 1 wherein the ratio of said halogenated hydrocarbon to said petroleum hydrocarbon is 99:1 to 50:50.

5. The process as defined in claim 4 wherein the ratio of said halogenated hydrocarbon to said petroleum hydrocarbon is 93:7.

* * * * *